US006666656B2

(12) United States Patent
Pressel

(10) Patent No.: US 6,666,656 B2
(45) Date of Patent: Dec. 23, 2003

(54) COMPRESSOR APPARATUS

(76) Inventor: Hans-Georg G. Pressel, P.O. Box 460413, Glendale Station, Denver, CO (US) 80246

( * ) Notice: Subject to any disclaimer, the term of this patent is extended or adjusted under 35 U.S.C. 154(b) by 0 days.

(21) Appl. No.: 10/081,956

(22) Filed: Feb. 20, 2002

(65) Prior Publication Data

US 2003/0072659 A1 Apr. 17, 2003

Related U.S. Application Data

(63) Continuation-in-part of application No. 09/976,816, filed on Oct. 12, 2001.

(51) Int. Cl.[7] ..... F04B 49/00

(52) U.S. Cl. ..... 417/295; 417/510; 137/512.3

(58) Field of Search ..... 417/295, 298, 417/446, 447, 567, 569, 570, 571, 522, 523, 269, 296, 510, 552, 553; 137/512.1–512.3, 512.13, 512.15, 516.13, 543.17, 843, 625.65, 240, 255, 242, 564

(56) References Cited

U.S. PATENT DOCUMENTS

| | | | | | |
|---|---|---|---|---|---|
| 209,673 | A | | 11/1878 | Grillenberger | |
| 898,659 | A | * | 9/1908 | Kuehl | 417/259 |
| 1,109,154 | A | * | 9/1914 | Thomas | 417/255 |
| 1,445,073 | A | | 2/1923 | Corpi et al. | |
| 1,688,890 | A | | 10/1928 | Spreen | |
| 2,431,859 | A | | 12/1947 | Fisher | |
| 3,338,509 | A | * | 8/1967 | McAninch | 230/172 |
| 3,403,845 | A | | 10/1968 | Marshall | |
| 3,653,783 | A | * | 4/1972 | Sauder | 417/298 |
| 4,059,367 | A | * | 11/1977 | Marshall | 417/203 |
| 4,478,243 | A | | 10/1984 | King | |
| 4,826,134 | A | | 5/1989 | Chapman | |
| 4,915,594 | A | * | 4/1990 | Lammers | 417/265 |
| 4,954,047 | A | | 9/1990 | Okuyama et al. | |
| 5,178,304 | A | | 1/1993 | Torterotot | |
| 5,411,375 | A | | 5/1995 | Bauer | |
| 5,613,837 | A | | 3/1997 | Konishi et al. | |
| 5,813,841 | A | | 9/1998 | Sturman | |
| 5,921,755 | A | | 7/1999 | Eldridge | |
| 6,293,763 | B1 | | 9/2001 | Yokomachi et al. | |

* cited by examiner

*Primary Examiner*—Cheryl J. Tyler
*Assistant Examiner*—Han L Liu
(74) *Attorney, Agent, or Firm*—John E. Reilly

(57) ABSTRACT

A fluid compressor controls opening and closing of a fluid intake port in the crankcase with a novel and improved form of gate control member which follows rotation of the crankshaft and times the opening and closing of the intake port to coordinate with the intake and discharge strokes of a piston which is reciprocal through a cylinder bore communicating with the crankcase, the piston having an intake valve, and a cylinder head at the end of the cylinder bore having only a discharge valve.

23 Claims, 9 Drawing Sheets

COMPRESSOR APPARATUS

CROSS-REFERENCE TO RELATED APPLICATION

This application is a continuation-in-part of patent application Ser. No. 09/976,816, filed Oct. 12, 2001 for SHUTTLE PISTON ASSEMBLY WITH DYNAMIC VALVE by Hans-Georg G. Pressel and incorporated by reference herein.

BACKGROUND AND FIELD OF INVENTION

This invention relates to compressors; and more particularly relates to a novel and improved method and means for regulating the intake and exhaust of air or other gaseous fluid into and from a compressor in a simplified and efficient manner.

Standard compressors typically operate with suction and discharge valves installed in a cylinder head which impose severe size limitations on the valves and on the amount of fluid that can be drawn in and discharged in each cycle. A related problem has to do with the time constraints imposed upon maintaining the intake valve in an open position over the maximum period of time during the intake stroke and the ability to draw in the maximum amount of air during the suction stroke.

In the past, it has been proposed to utilize a compressor having a crankcase in combination with a cylinder and cylinder head and in such a way as to direct the intake air into the crankcase prior to forcing it into the cylinder. Representative patents are U.S. Pat. Nos. 209,673 to Grillenberger; 1,109,154 to Thomas; 1,445,073 to Corpi and 5,613,837 to Conishi. To my knowledge, however, no one has successfully devised an air compressor which is capable of operating at maximum efficiency over the greater portion of the suction and discharge cycles. In particular, there is a need for a compressor which will make maximum utilization of a crankshaft over the entire intake stroke as well as to draw in-the maximum amount of pre-pressurized air for discharge over each discharge stroke. In so doing, it is highly desirable to control the timing and duration of opening and closing of an intake port in the crankcase during each intake and compression stroke, respectively, in close coordination with rotation of the crankshaft and reciprocation of the piston.

SUMMARY OF THE INVENTION

It is therefore an object of the present invention to provide for a novel and improved compressor.

It is another object of the present invention to provide for a method and means for increasing the volumetric efficiency of an air compressor in a highly simplified and efficient manner.

It is a further object of the present invention to provide for a novel and improved method and means for pre-pressurizing air to be drawn into one or more cylinders of an air compressor and for regulating the opening and closing of an intake port which supplies the pre-pressurized air to the crankcase.

It is a still further object of the present invention to provide for a novel and improved method of controlling the duration of opening and closing of an intake port leading into a crankcase chamber in close coordination with the suction and discharge stroke of the piston.

In accordance with the present invention, in a compressor of the type having a crankcase, a cylinder communicating with the crankcase through an outer peripheral wall and having an exhaust valve at one end, the combination therewith comprises a fluid intake port communicating with the crankcase through one end of the chamber substantially diametrically opposed to the cylinder, a piston reciprocal in the cylinder having an intake valve, a crankshaft mounted for rotation in the crankcase including gate control means for opening and closing the intake port through each revolution of the crankshaft, the gate control means being operative in response to rotation of the crankshaft through each revolution to start to close the intake port prior to advancement of the piston to one end of its stroke adjacent to the exhaust valve and to start to open the intake port prior to advancement of the piston to an opposite end of its stroke away from the exhaust valve. Preferably, the intake valve is of the leaflet type which is capable of rapidly opening and closing in response to changes in pressure and piston inertia, and the gate control means is operative to open the intake port in the crankcase through at least 180° of each revolution of the crankshaft.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 11:
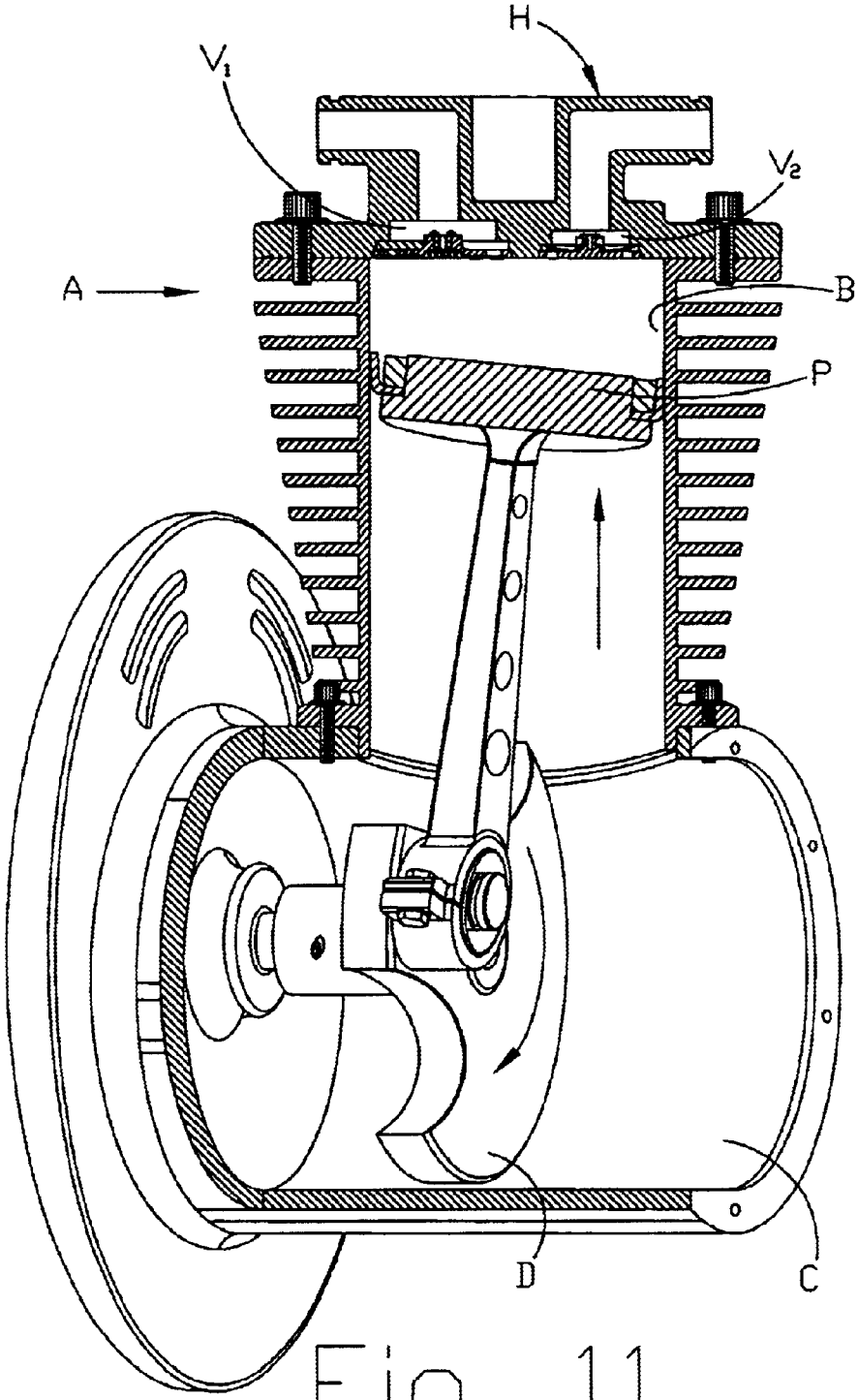
Fig. 11 PRIOR ART
FIG. 11 is a sectional view of a standard compressor.

Referring in more detail to the drawings, there is shown by way of illustrative example in FIG. 11 a conventional compressor A which is made up of a crankcase C in which a crankshaft D rotates and, in turn, reciprocates a piston P through cylinder bore B. A cylinder head H at one end of the cylinder B contains an intake valve $V_1$ and a discharge valve $V_2$. In a typical operation, as the crankshaft D is rotated by any suitable motor, the piston P is reciprocated through a suction stroke away from the cylinder head H to induce air into the cylinder, followed by a discharge stroke toward the cylinder head H to pressurize the air and force it through the discharge valve $V_2$. In accordance with the present invention, it is possible to greatly enhance the capacity, efficiency and performance of the standard compressor by substitution of a novel and improved crankshaft assembly and piston for the existing crankshaft and piston described, modifying the cylinder head to contain only the discharge valve in place of the valve $V_2$ and placement of a dynamic intake valve in the piston in place of the valve $V_1$. The crankcase is modified to include an intake manifold for the introduction of air into the crankcase on the suction stroke, and the crankcase is modified to include a gate control member to coordinate the opening and closing of the intake manifold with the reciprocation of the piston through its suction and discharge strokes.

In the preferred form of invention shown in FIGS. 1 to 9, a crankcase 10 of hollow circular configuration has an outer peripheral wall 12 which is bounded by opposite flat side walls 13 and 14. An intake manifold 16 extends through the wall 13 and terminates in an intake port 18 which is flush with a circular intake plate 20. The intake plate 20 is firmly anchored to the wall 13 by the intake manifold 16 as well as one or more support studs 22 so as to be in interspaced parallel relation to the side wall 13. Circumferentially spaced radial grooves 24 are disposed in the surface of the plate 20.

A crankshaft 25 includes a drive sleeve 26 which is keyed for rotation on output shaft 27 of a motor M. The crankshaft 25 is in the form of a generally circular plate having a drive pin 32 in offset relation to the drive sleeve 26 for insertion through a bearing 34 in one end 35 of a connecting rod 36 so as to mount the connecting rod in journaled relation to the drive pin 32.

An important feature of the present invention resides in a control gate 40 which is in the form of an annular disk or plate of semi-circular configuration mounted in spaced parallel relation to the crankshaft 25 by pin members 42 which extend at circumferentially spaced intervals from the plate 40 and are slidable in bores 41 in the crankshaft 25 so that the gate 40 is fixed for rotation with the crank. Compression springs 44 are disposed on the pins 42 to yieldingly urge the gate 40 into sealed engagement with the intake plate 20. The contacting surfaces of the plate 20 and gate 40 are composed of a low friction material and the gate 40 is aligned to traverse the intake port 18 so as to close the intake port for a predetermined time interval and number of degrees of each revolution of the crank.

A cylinder bore 46 extends radially from a portion of the peripheral wall 12 of the crankcase so as to be in open communication with the crankcase. The cylinder bore 46 is preferably offset with respect to the crankcase in order to reduce the connecting rod angle during the compression stroke in a manner to be described. A piston 48 at the free end of the connecting rod opposite to the drive pin is slidable in sealed relation to the cylinder bore 46 and contains a dynamic intake valve 50 to be hereinafter described in more detail. A cylinder head 52 is mounted on the open end of the cylinder bore 46 opposite to the crankcase including a passage 53 in which a exhaust valve 54 is positioned for the controlled discharge of compressed air through the cylinder. The exhaust valve 54 corresponds to the discharge or exhaust valve described in my hereinbefore referred to application for patent for SHUTTLE PISTON ASSEMBLY WITH DYNAMIC VALVE which is incorporated by reference herein.

A filler block 56 is mounted in the crankcase chamber to regulate the volumetric ratio between the crankcase 10 and cylinder bore 46. An additional filler block may be positioned as at 59 in order to further reduce the open space in the crankcase to achieve a predetermined volumetric ratio with the cylinder bore 46. The filler blocks 56 and 59 may be composed of any non-porous lightweight material, such as, a plastic foam and is particularly useful in retrofitting existing or standard compressors for use in accordance with the present invention. Nevertheless, it will be evident that the same volumetric ratio may be achieved in dimensioning the chamber within the crankcase to be at the desired volume or size in relation to the cylinder bore so as to achieve a particular volumetric ratio. It is important to keep the crankcase cavity as small as possible for maximum pre-compression of the air entering the crankcase prior to discharge through the cylinder and it is therefore desirable that the maximum space available in the crankcase be less than that in the cylinder bore 46.

Preferably, the volumetric ratio between a crankcase and cylinder is in the range of 0.85 to 1.0. In addition, it is desirable to incorporate a slight offset between the inner connecting end of the cylinder bore 46 to the peripheral wall 12 of the crankcase so as to reduce the connecting rod angle as it advances through the cylinder bore 46 and thereby reduces the torque and power required. Most of the power is required in the discharge cycle when the compressor is building up pressure, and the greater the connecting rod angle the more torque that is needed to drive the compressor. The cylinder offset as described avoids the necessity of lengthening the connecting rod and cylinder to reduce the connecting rod angle.

In the preferred form, the piston head 48 is connected in fixed relation to the free end of the connecting rod 36, and the dynamic intake valve 50 is incorporated into the piston head 48 in the manner described in my hereinbefore referred to co-pending application for patent Ser. No. 09/976,816. Specifically, the piston 48 is made up of an annular disk 48' having a circumferential groove 57 in outer peripheral edge 58. The edge 58 is of convex configuration so that the cylinder bore 46 will remain on a tangent to the edge 58 notwithstanding movement of the piston head 48 away from the longitudinal axis of the cylinder bore 46 as it is reciprocated. The groove 57 is dimensioned for insertion of a seal 77 and backing member 78 behind the seal. A radially inner wall 60 of the disk 48' tapers into a shoulder 62 which is united with an enlarged end 64 of the connecting rod 36. A valve seat 65 is mounted on the shoulder 62 and has kidney-shaped ports 66, and a leaflet valve member 70 is mounted at its center to the valve seat 65 by a rivet 72. The valve 70 has leaflet portions 74 which are free to flex away from the center portion or rivet 72 as the piston moves away from its associated cylinder head 52 into abutting relation to a limit stop 74.

The mass of the leaflet portions 70 is regulated to match the inertia of the piston 48 and to cause the leaflet portion 70 to snap open instantly when the piston 48 starts to move away from the cylinder head 52. There is a limited distance that the piston 48 must travel away from the exhaust valve 54 before atmospheric pressure overcomes the negative pressure in the cylinder forcing the intake valve 50 open. By controlling the mass of the leaflet portions 70 at their greatest distance from the flex point, it is possible to cause the valve 50 to snap open as soon as the piston 48 moves away from the exhaust valve 54. This increases the time of opening of the valve 50 and retains it open over a longer time interval during its intake stroke thereby substantially increasing compressor efficiency and performance.

At the end of each intake stroke and compression stroke and, since the piston will have moved a limited distance of the intake stroke to create a large enough void to force the intake valve open, could easily amount to between 10° to 25° of the total crankshaft revolution. However, as the piston 48 travels away from the exhaust valve 54, it increases in speed and reaches maximum velocity when the crankshaft reaches the 90° rotating position. At that point, the piston head 48 will draw the majority of the air from the crankcase. As the crankshaft reaches the next 180° position or end of the stroke, the piston 48 will have slowed down and become static so that little or no air is drawn from the crankcase. Again, the failure to draw air into the cylinder near the top dead center (TDC) or bottom dead center (BDC) would normally account for a waste of 10° to 25° of crankshaft rotation at the end of each intake and compression stroke. However, the total loss of 20° to 50° of crankshaft rotation can be offset by controlling the opening and closing of the intake port 18 without depending upon the piston position and the created void in relation to the crankshaft; also, the intake port 18 can be kept open for greater than 180° of the crankshaft revolution thereby filling the crankcase with a high volume of air, such as, by opening the intake port 18 28° before BDC and closing the intake port 18 25° to 30° before TDC.

The dynamic intake valve 50 controls the air pressure required to open and close the valve 50 thereby sacrificing as little energy as possible to overcome the air pressure against the leaflets 74. The lesser the force required to open and close the valve 50, the greater efficiency is achieved, since the valve 50 opens earlier in the suction cycle. This can be determined by measuring the negative pressure or suction required in the cylinder bore 46 and timing the opening of the valve 50 in response to the vacuum created. This vacuum is created as the piston 48 moves away from the cylinder head 52 in the suction stroke and increases the negative pressure until the pre-pressurized crankcase air pressure overcomes the dynamic valve leaflet tension to open and fill the cylinder bore 46. The distance that the piston 48 must travel to produce enough negative pressure to open the valve 50 in relation to the total stroke can be expressed in degrees of crankshaft rotation and can be calculated in real time.

Figures 8, 9:
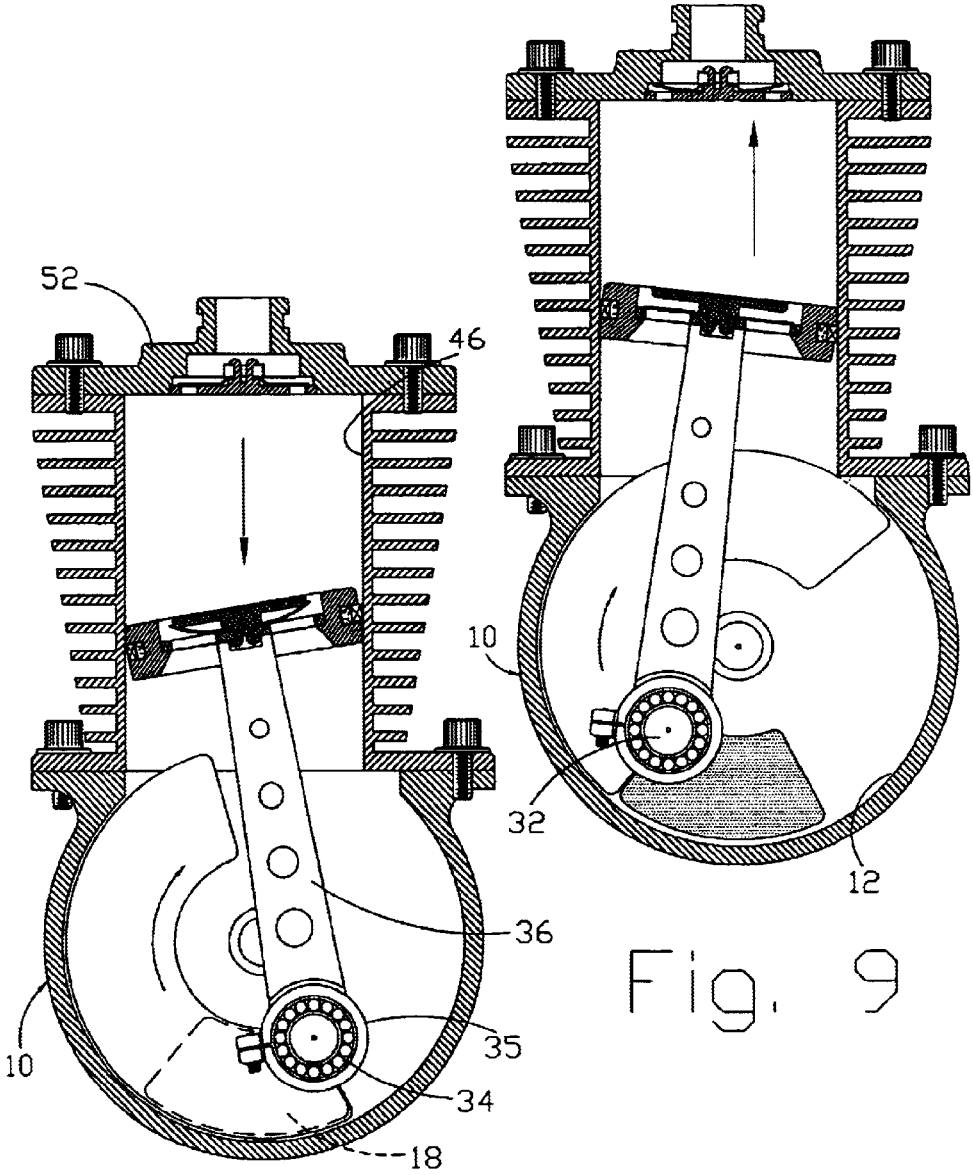

The gate control member 40 regulates opening and closing of the intake port 18, and the intake port 18 is designed to permit the greatest volume of air possible to enter the crankcase chamber at a relatively low air velocity and high air pressure. Thus, as the piston 48 advances toward the cylinder head at 52, air is drawn through the intake port 18 into the crankcase. The gate control 40 rotates with the crankshaft 25 and is so constructed and arranged, by reference to FIGS. 6 to 9, that as the piston 48 reaches the end of its intake stroke, the leading edge of the gate control 40 will start to close the intake port 18. As the piston 48 travels away from the cylinder head 52, the intake port 18 is closed and the air in the crankcase is compressed then forced through the dynamic intake valve 50 so as to fill the cylinder 46 with the compressed air. As the piston 48 travels away from the cylinder head 52 it will increase in speed and reach the highest velocity when the crankshaft reaches the 90° rotating position so as to draw the majority of the air through the intake valve 50 at that point. On the other hand, as the crankshaft 25 reaches the 180° rotating position, as shown in FIG. 8, the piston 48 will have slowed down and become relatively static at that position. As stated earlier, normally, the failure to draw air into the cylinder 46 near the top dead center (TDC) or bottom dead center (BDC) of the piston position can account for a waste of 10° to 25° of crankshaft rotation at each position. However, with the gate control member 40 it is possible to control and time the opening and closing of the intake port 18 without depending on the position of the piston 48 in relation to the crankshaft 25 and control the timing only with the position of the crankshaft 25. For example, it is possible to gain as much as 56° of the crankshaft revolution in traversing from 35° before TDC to 28° after TDC; and to increase the opening time of the intake port 18 up to 236° of the crankshaft revolution thereby filling the crankcase with a high volume of air which is then forced into the cylinder bore 46 through the dynamic intake valve 50. This is partially attributable to opening of the intake port 18 28° before piston BDC and closing the intake port 18 35° before piston TDC, bearing in mind that the piston 48 is already cycling from the suction stroke into the compression stroke and air is still entering the crankcase because of the pressure build-up in the intake manifold.

Figure 1:
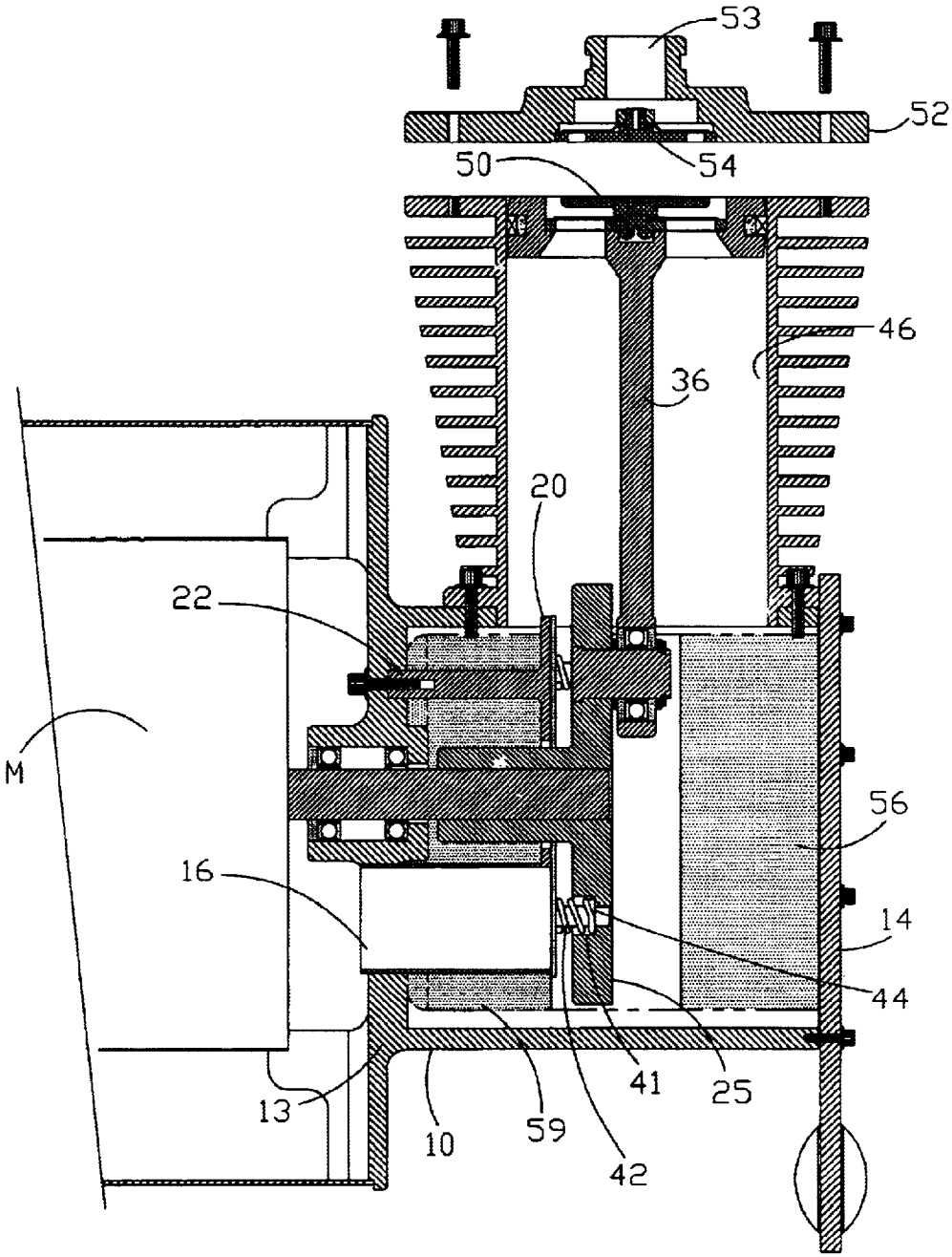
FIG. 1 is a sectional exploded view of a preferred form of compressor in accordance with the present invention illustrating the piston at the end of its suction stroke.
Figure 2:
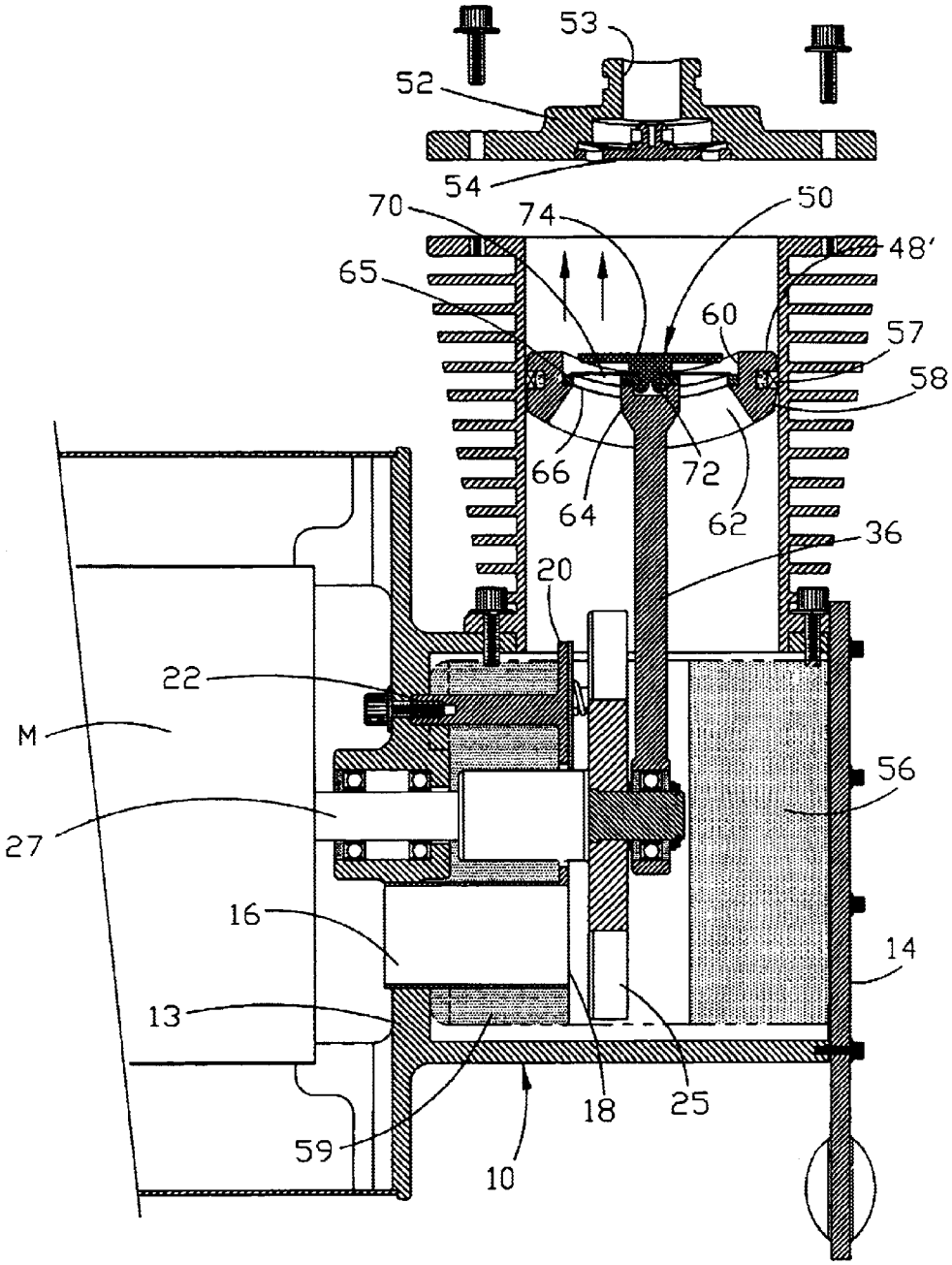
FIG. 2 is another sectional exploded view of the preferred form shown in FIG. 1 illustrating movement of the piston through the cylinder.
Figure 3:
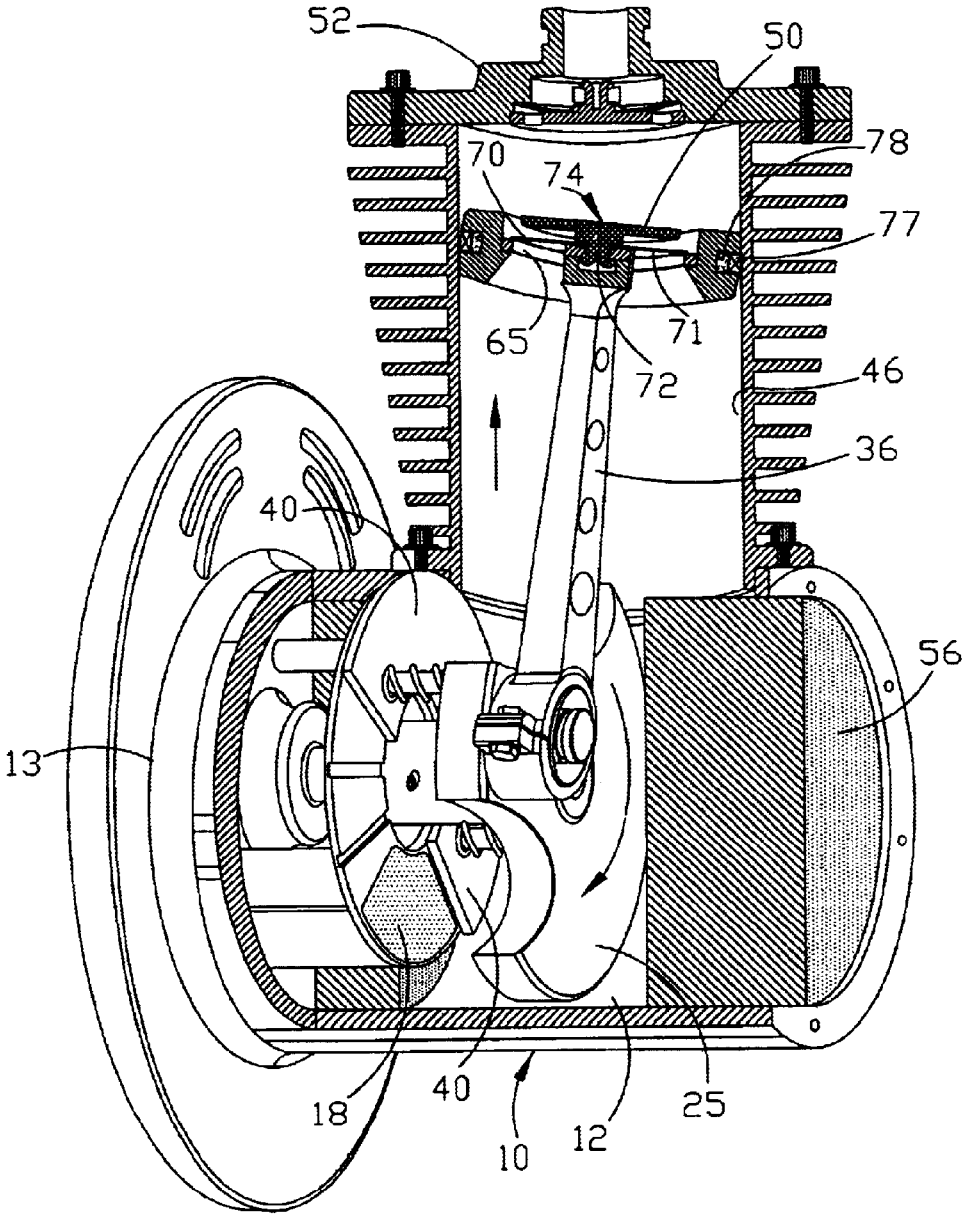
FIG. 3 is a somewhat perspective view with portions broken away of the preferred form of compressor shown in FIGS. 1 and 2.
Figure 4:
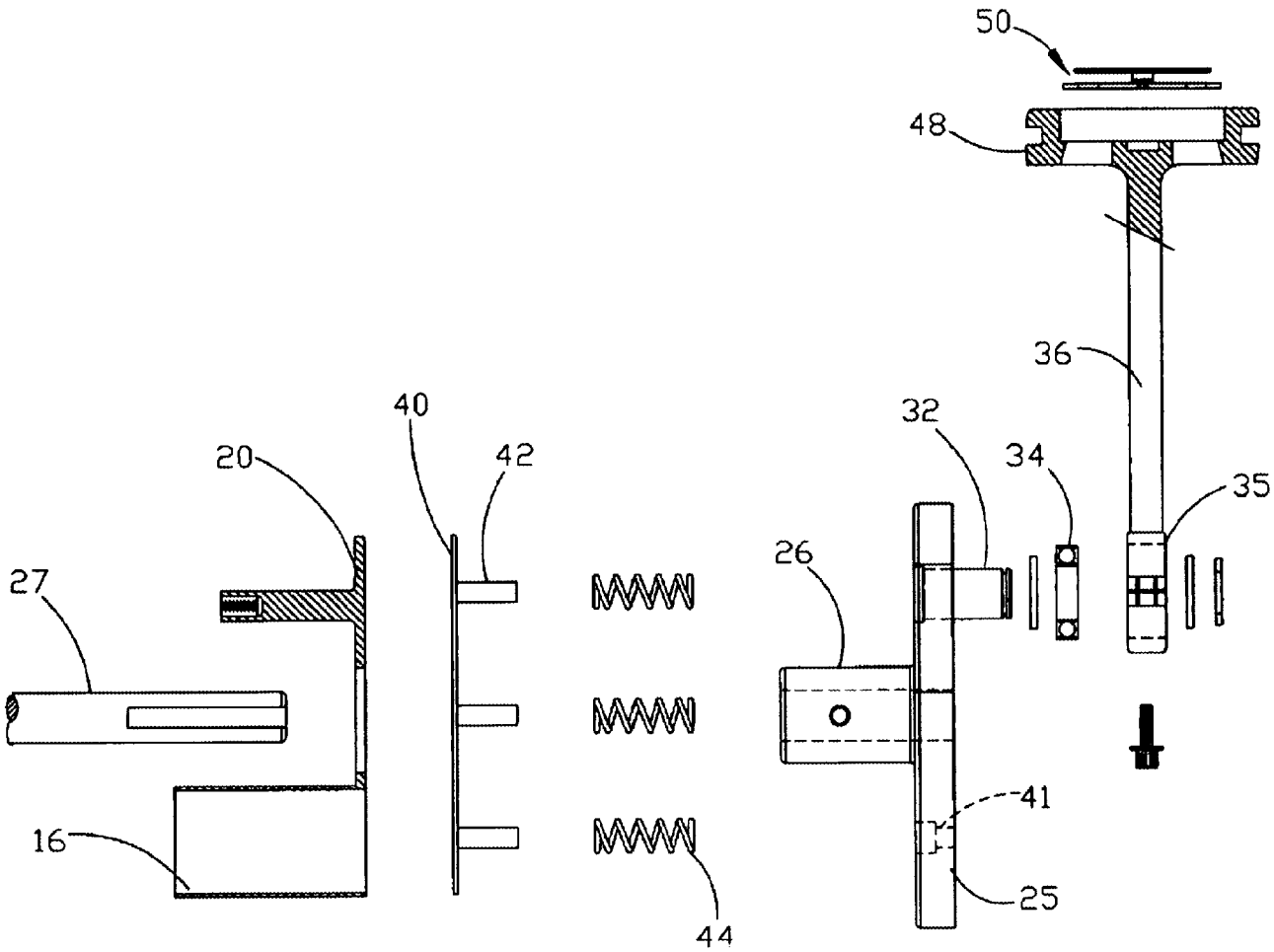
FIG. 4 is an exploded view of the moving parts of the compressor shown in relation to the stationary intake manifold in the crankcase.
Figure 5:
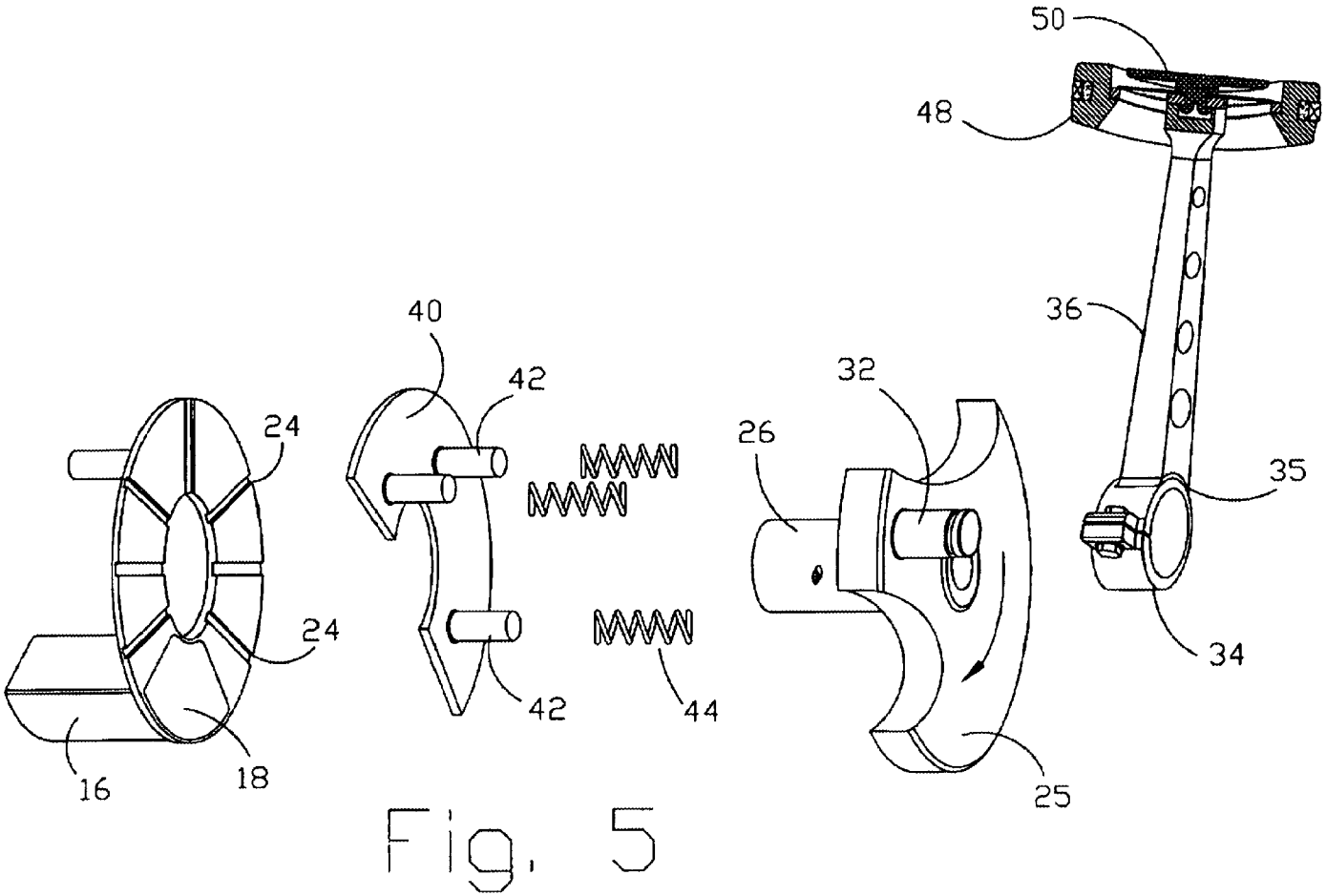
FIG. 5 is another exploded view in perspective form of the elements shown in FIG. 4.
Figure 6:
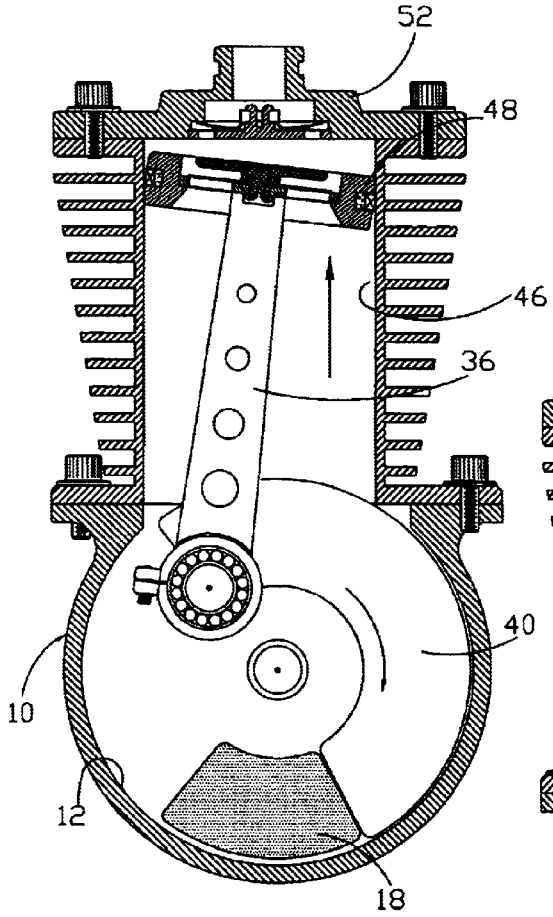
FIGS. 6 to 9 are sectional views illustrating the sequence of movement of the compressor crankshaft and piston through each revolution in accordance with the present invention.
Figure 7:
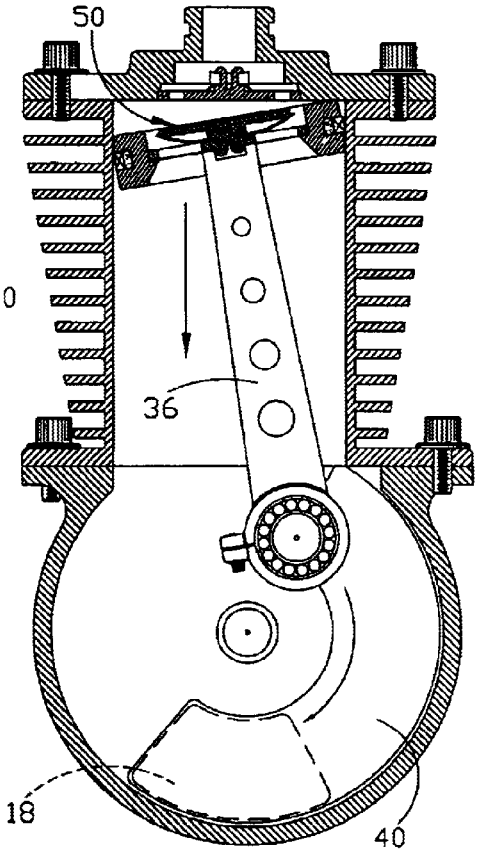

From the foregoing, it is not necessary to depend upon the piston 48 to produce the negative pressure to open the dynamic intake valve 50 but instead time the opening of the intake port 18 to take advantage of the build-up in pressure of the air which accumulates in the intake manifold 16 as the piston advances through its intake stroke. In this way, as the piston and its connecting rod advance through BDC, where normally little or no air is drawn into the crankcase, the pressure build-up of air in the intake manifold 16 will more than compensate for the normally dead period of the cycle and almost double the cylinder filling time from approximately 120° to 140° to 235° to 245° of the crankshaft revolution. In short, closing the intake port 18 on the order of 35° before piston TDC, as shown in FIG. 6, completing closure of the port on the order of 28° after TDC, and opening the intake port 18 on the order of 35° before piston BDC, as shown in FIG. 8, can result in as much as 29% improvement in performance for the average compressor which is retrofitted in accordance with the present invention.

It will be apparent that the air flow through the intake manifold varies with compressor rpms, the diameter and length of the intake manifold and the diameter of the dynamic intake valve 50. The higher the compressor rpms with respect to a small diameter intake manifold and intake valve the higher the air velocity through the manifold and the lower the air pressure. It is therefore important to install the largest intake manifold and intake valve possible to reduce the air velocity and increase the pressure so as to increase the amount of air drawn into the crankcase during each intake stroke.

DETAILED DESCRIPTION OF MODIFIED FORM OF INVENTION

Figure 10:
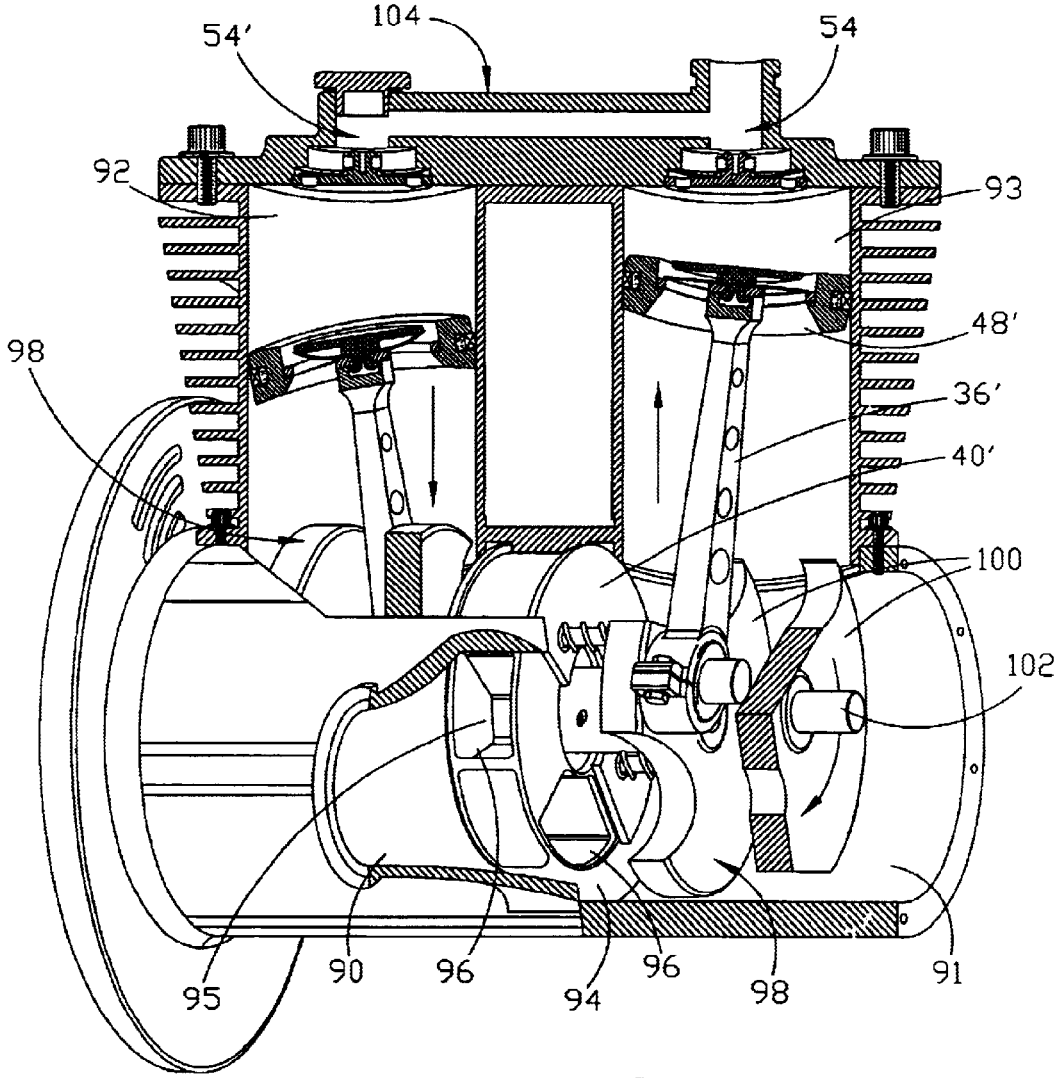
FIG. 10 is a sectional view with portions broken away of a two-cylinder compressor in accordance with the present invention.

The advantages and features of the single cylinder compressor described can be incorporated into a multi-cylinder compressor as well. For example, as illustrated in FIG. 10, a crankcase is divided into a pair of crankcase chambers 90 and 91 and cylinders 92 and 93, respectively, by a common partition 94. The partition has an intake manifold 95 leading into intake ports 96 communicating with each respective chamber 90 and 91. There is a crankshaft assembly 98 in each chamber 90 and 91 wherein each crankshaft assembly 98 has dual crankshafts 100 flanking a connecting rod 36' for a piston 48', like parts being correspondingly enumerated with prime numerals to those of the preferred form, including control gate 40' which advances across each intake port 96. A common output or drive shaft 102 from a motor, not shown, is keyed for rotation of the crankshafts 100. Also, a common cylinder head 104 is provided for a pair of exhaust valves 54' at the top of each cylinder 92 and 93.

In operation, the crankshafts 100 are mounted in 180° out-of-phase relation with respect to one another so that as one is undergoing its intake stroke the other will undergo its discharge stroke and counterbalance one another in undergoing high speed rotation as well as to successively draw air from the intake manifold 95 through a respective intake port 96.

From the foregoing, the efficiency and performance of standard air compressors of the type having a crankcase and cylinder can be greatly enhanced by controlling both the timing and duration of opening and closing of an intake manifold with a gate control member on a crankshaft in close coordination with the size of the manifold, the volumetric ratio between the crankcase and cylinder and length of piston stroke through the cylinder. It is therefore to be understood that while preferred and modified forms of invention are herein set forth and described the above and other modifications may be made therein without departing from the spirit and scope of the invention as defined by the appended claims and reasonable equivalents thereof.

I claim:

1. In a fluid compressor having a crankcase defining a chamber, a cylinder communicating with said chamber through an outer peripheral wall of said chamber having an exhaust valve at one end thereof, and a piston reciprocal in said cylinder having an intake valve, the improvement comprising:

a) a fluid intake port communicating with said chamber substantially diametrically opposed to said cylinder;

b) a crankshaft mounted for rotation in said chamber including gate control means rotatably mounted on said crankshaft for opening and closing said intake port through each revolution of said crankshaft;

c) said gate control means being operative in response to rotation of said crankshaft through each revolution to close said intake port a selected time interval prior to advancement of said piston to one end of its stroke adjacent to said exhaust valve and to open said intake port a selected time interval prior to advancement of said piston to an opposite end of its stroke away from said exhaust valve; and d) wherein said intake valve is operative in response to increasing fluid pressure in said crankcase as said piston moves toward said opposite end of its stroke to move to an open position for passage of fluid under pressure from said chamber through said intake valve toward said exhaust valve.

2. In a fluid compressor according to claim 1 wherein said gate control means is further operative to open said intake port over a limited time interval correlated with advancement of said piston from said opposite end of said stroke toward said one end of said stroke.

3. In a fluid compressor according to claim 2 wherein said gate control means is operative to open said intake port through at least 180° of each revolution of said crankshaft.

4. In a fluid compressor according to claim 1 wherein said outer peripheral wall of said chamber is generally cylindrical and is bounded by opposite flat side wall portions, said intake port communicating with said chamber through one of said side wall portions.

5. In a fluid compressor according to claim 1 wherein biasing means yieldably urges said gate control means into fluid-tight relation to said port and said biasing means includes at least one spring interposed between said crankshaft and said gate.

6. In a fluid compressor according to claim 1 wherein said gate control means is of semi-circular configuration and traverses said intake port over substantially one-half of each revolution.

7. In a fluid compressor according to claim 6 wherein said gate control means traverses said intake port through substantially 180° of each revolution.

8. In a fluid compressor having a crankcase defining a chamber, a cylinder communicating with said chamber through an outer peripheral wall of said chamber having an exhaust valve at one end thereof, the improvement comprising:

a) a fluid intake port communicating with one end of said chamber substantially diametrically opposed to said cylinder;

b) a piston reciprocal in said cylinder having a connecting rod and an intake valve at one end thereof, said intake valve having at least one leaflet portion responsive to changes in pressure differential on opposite sides of said leaflet portion to move between open and closed positions;

c) a crankshaft mounted for rotation in said chamber including gate control means rotatably mounted on said crankshaft for opening and closing said intake port through each revolution of said crankshaft; and d) said gate control means being operative in response to rotation of said crankshaft through each revolution to close said intake port a selected time interval prior to advancement of said piston to one end of its stroke adjacent to said exhaust valve and to open said intake port a selected time interval prior to advancement of said piston to an opposite end of its stroke away from said exhaust valve.

9. In a fluid compressor according to claim 8 wherein said gate control means is in the form of an annular plate.

10. In a fluid compressor according to claim 8 wherein said piston is reciprocal through a first intake stroke which terminates at a top dead center position with respect to said exhaust valve and a compression stroke which terminates at a bottom dead center position away from said exhaust valve, said gate control means being coordinated with reciprocal movement of said piston to initiate closing of said intake port prior to said piston reaching its top dead center position and to maintain said intake port in the closed position through substantially 115° to 125° of each revolution.

11. In a fluid compressor according to claim 10 wherein said gate control means initiates opening of said intake port just prior to said piston traversing its bottom dead center position and retains said intake port in an open position through substantially 235° to 245° of each said revolution.

12. In a fluid compressor according to claim 8 wherein said outer peripheral wall of said chamber is generally cylindrical and is bounded by opposite flat side wall portions, said intake port communicating with said chamber through one of said side wall portions.

13. In a fluid compressor according to claim 8 wherein biasing means yieldably urges said gate control means into fluid-tight relation to said port and said biasing means includes a plurality of springs interposed between said crankshaft and said gate.

14. An air compressor comprising in combination:

a crankcase;

a cylinder extending radially from said crankcase and terminating in a cylinder head having an exhaust valve therein;

a fluid intake manifold communicating with said crankcase through a side wall at one end of said crankcase substantially diametrically opposed to said cylinder;

a crankshaft mounted for rotation in said crankcase including a gate control member rotatably mounted on said crankshaft for opening and closing an intake port during each revolution of said crankshaft;

a piston reciprocal through said cylinder having a connecting rod extending from said crankshaft and terminating in an intake valve at an opposite end, said intake valve having leaflet portions responsive to differential pressure on opposite sides of said leaflet portions and piston inertia to move between open and closed positions; and wherein said gate control member is dimensioned to close said intake port over a selected time interval prior to advancement of said piston to one end of its stroke adjacent to said exhaust valve and to open said intake port a selected time interval prior to advancement of said piston to an opposite end of said stroke away from said exhaust valve.

15. An air compressor according to claim 14 wherein said compressor has more than one of said cylinders and said crankcases, a crankshaft mounted for rotation in each said crankcase including a gate control member for opening and closing an intake port in said respective crankcase during each revolution of said crankshaft, said intake port communicating with said intake manifold for each said crankcase, and said gate control members opening and closing said intake ports in out-of-phase relation to one another.

16. An air compressor according to claim 14 wherein said intake valve is operative in response to increasing fluid pressure in said cylinder and piston inertia as said piston moves toward said opposite end of its stroke to move to an open position for passage of fluid under pressure from said chamber through said intake valve toward said exhaust valve.

17. An air compressor according to claim 14 wherein an outer peripheral wall of a chamber is generally cylindrical and is bounded by opposite flat side wall portions, said intake port communicating with said chamber through one of said side wall portions.

18. An air compressor according to claim 14 wherein biasing means yieldably urges said gate control means into fluid-tight relation to said port and said biasing means includes a plurality of springs interposed between said crankshaft and said gate.

19. An air compressor according to claim 14 wherein said gate control means is of generally circular configuration and traverses said intake port over substantially one-half of each revolution.

20. An air compressor according to claim 19 wherein said gate control means traverses said intake port through substantially 115° to 125° of each revolution.

21. An air compressor according to claim 14 wherein said piston is reciprocal through a first intake stroke which terminates at a top dead center position with respect to said exhaust valve and a compression stroke which terminates at a bottom dead center position away from said exhaust valve, said gate control means being coordinated with reciprocal movement of said piston to initiate closing of said intake port prior to said piston reaching its top dead center position and to maintain said intake port in the closed position through substantially 115° to 125° of each revolution.

22. An air compressor according to claim 14 wherein said gate control means initiates opening of said intake port just prior to said piston traversing its bottom dead center position and retaining said intake port in an open position through the balance of each said revolution.

23. An air compressor according to claim 14 wherein said compressor has more than one of said cylinders and said crankcases, a crankshaft mounted for rotation in each said crankcase including a gate control member for opening and closing an intake port in said respective crankcase during each revolution of said crankshaft, said intake port communicating with said intake manifold for each said crankcase, and said gate control members opening and closing said intake ports in out-of-phase relation to one another.

* * * * *

UNITED STATES PATENT AND TRADEMARK OFFICE

CERTIFICATE OF CORRECTION

PATENT NO. : 6,666,656 B2
DATED : December 23, 2003
INVENTOR(S) : Hans-Georg G. Pressel It is certified that error appears in the above-identified patent and that said Letters Patent is hereby corrected as shown below:

Column 3,
Line 37, cancel “interspaced” and substitute -- inner spaced --

Column 4,
Line 39, cancel “reduces” and substitute -- reduce --
Line 64, cancel “74” and substitute -- 71 --

Column 5,
Line 1, cancel “70” and substitute -- 71 --
Line 2, cancel “portion 70” and substitute -- portions 71 --
Line 8, cancel “70” and substitute -- 71 --
Line 43, cancel “74” and substitute -- 71 --

Signed and Sealed this

Twenty-ninth Day of June, 2004

JON W. DUDAS
*Acting Director of the United States Patent and Trademark Office*